US006006539A

United States Patent [19]

Lim et al.

[11] Patent Number: 6,006,539

[45] Date of Patent: Dec. 28, 1999

[54] APPARATUS FOR DISPENSING COOL AIR VERTICALLY AND HORIZONTALLY IN A REFRIGERATOR

[75] Inventors: Jae-Hoon Lim, Suwon; Jung-Hoon Lee, Kwangju; Sang-Gyu Jung, Kwangju; Sun-Guy Lee, Kwangju; Chan-Ho Kim, Kwangju, all of Rep. of Korea

[73] Assignee: Samsung Electronics Co., Ltd., Suwon, Rep. of Korea

[21] Appl. No.: 09/129,182

[22] Filed: Aug. 4, 1998

[30] Foreign Application Priority Data

| | | | |
|---|---|---|---|
| Sep. 27, 1997 | [KR] | Rep. of Korea | U.M. 97-26845 |
| Sep. 27, 1997 | [KR] | Rep. of Korea | U.M. 97-26846 |
| Sep. 27, 1997 | [KR] | Rep. of Korea | P97-49450 |
| Sep. 27, 1997 | [KR] | Rep. of Korea | P97-49451 |

[51] Int. Cl.[6] ..... F25D 17/04

[52] U.S. Cl. ..... 62/408; 62/419

[58] Field of Search ..... 62/408, 419, 426, 62/404, 407, 409, 413, 414, 425, 440, 441, 455; 454/285

[56] References Cited

U.S. PATENT DOCUMENTS

| | | | |
|---|---|---|---|
| 5,664,437 | 9/1997 | Park et al. | 62/407 |
| 5,718,123 | 2/1998 | Park et al. | 62/407 |
| 5,735,138 | 4/1998 | Park et al. | 62/419 |
| 5,755,112 | 5/1998 | Kang | 62/407 |
| 5,799,500 | 9/1998 | Kang | 62/408 |
| 5,802,867 | 9/1998 | Kang | 62/408 |
| 5,918,479 | 7/1999 | Ji et al. | 62/441 |

*Primary Examiner*—William E. Tapoicai
*Attorney, Agent, or Firm*—Burns, Doanne, Swecker & Mathis, L.L.P.

[57] ABSTRACT

A refrigerator includes a main body, freezing and refrigerating compartments formed in the main body, an evaporator for generating cool air, and a cool air dispersing system for dispersing cool air in the refrigerating compartment. The cool air dispersing system has a horizontal cool air dispersing device rotatable about a vertical axis for dispersing the cool air in a horizontal direction, a motor for rotating the horizontal cool air dispersing device, and a vertical cool air dispersing device for dispersing the cool air in the vertical direction. A force converting device is provided for vertically moving the vertical cool air dispersing device using a rotational force of the horizontal cool air dispersing device.

19 Claims, 10 Drawing Sheets

FIG. 7A
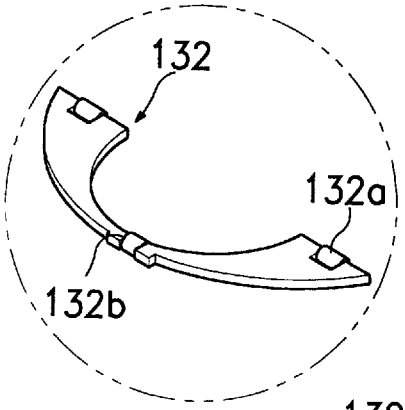
FIG. 7
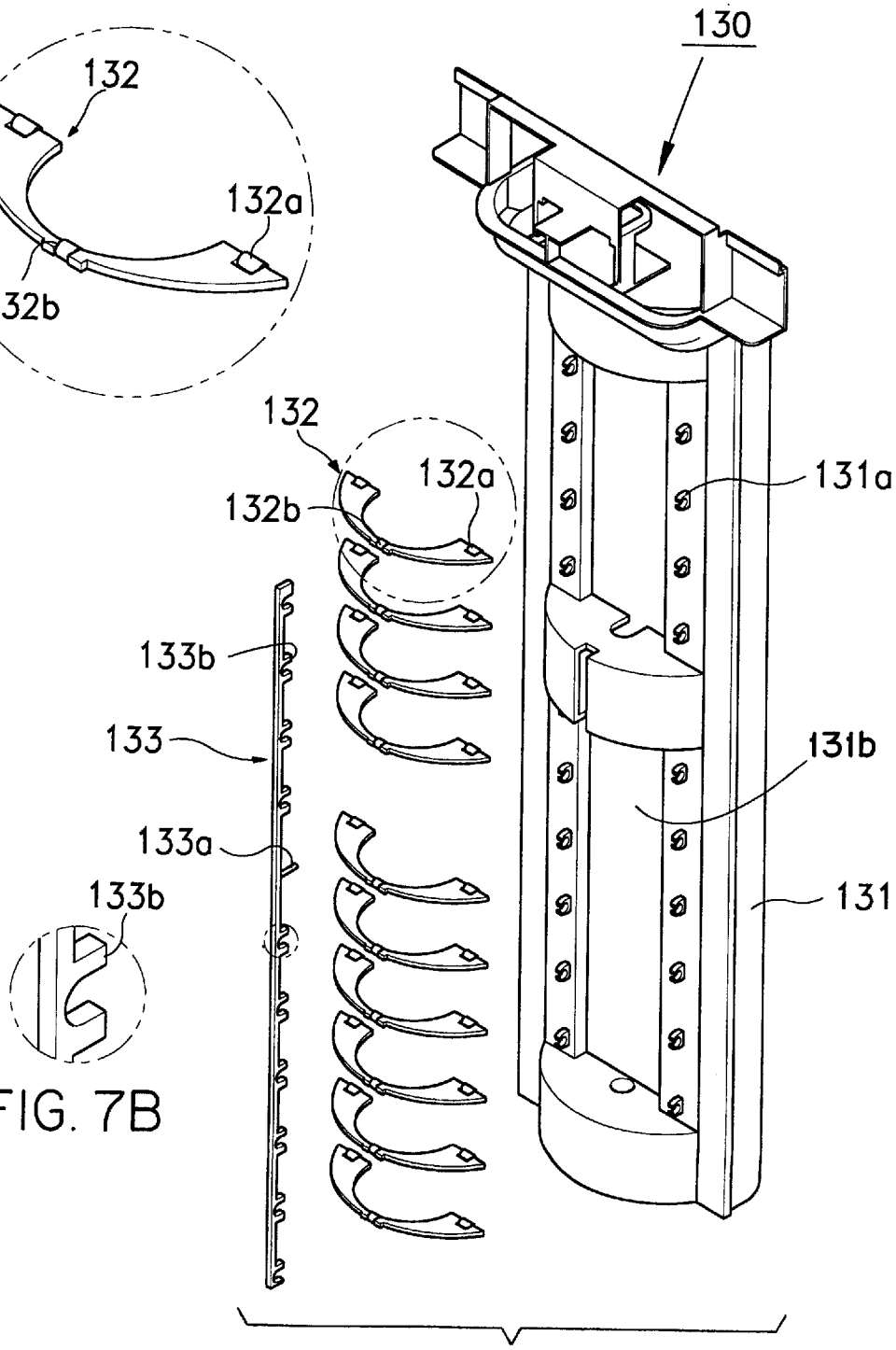
FIG. 7B

APPARATUS FOR DISPENSING COOL AIR VERTICALLY AND HORIZONTALLY IN A REFRIGERATOR

BACKGROUND OF THE INVENTION (1) Field of the Invention

The present invention relates to a refrigerator, and more particularly, to a cool air dispersing system that can disperse cool air in a vertical direction as well as in a horizontal direction in a refrigerating compartment.

(2) Description of the Prior Art

Refrigerators generally have freezing and refrigerating compartments that are cooled to below freezing and above freezing temperatures, respectively, by a coolant circulated according to a refrigerating cycle so that food and beverages stored in the refrigerator are maintained in frozen or refrigerated states, thereby enabling the food and beverages to remain fresh longer.

FIG. 1 shows a side-sectional view of a conventional refrigerator.

As shown in the drawing, the conventional refrigerator includes a main body 1 defining an exterior of the refrigerator, freezing and refrigerating compartments 2 and 3 provided in the main body 1, an evaporator installed behind the freezing compartment 2 for generating cool air, and a fan 5 installed inside the main body 1 for forcing the cool air generated by the evaporator 4 into the freezing and refrigerating compartments 2 and 3.

Respectively provided at the rear of the freezing and refrigerating compartments 2 and 3 are ducts 2*a* and 3*a* for guiding the cool air generated by the evaporator 4 into the freezing and refrigerating compartments 2 and 3 by means of the fan 5.

Disposed in the duct 3*a* is a cool air dispersing system 6 having a horizontal cool air dispersing device 7 for dispersing cool air in a horizontal direction within the refrigerating compartment 3 and a motor 6*a* for rotating the horizontal cool air dispersing device 7.

FIG. 2 shows an exploded perspective view of the horizontal cool air dispersing device 7.

The horizontal cool air dispersing device 7 is divided into upper and lower parts 7*a* and 7*b* each including a plurality of air guide portions 8. A rotating shaft 9 connecting the air guide portions 8 to each other is provided on each of the upper and lower parts 7*a* and 7*b*.

The horizontal air dispersing device 7 is divided into the separate upper and lower parts 7*a* and 7*b* to avoid a problem when manufacturing the device by a casting method. That is, to effectively disperse the cool air, the air guide portions 8 should be disposed at different angles from each other. As a result, the horizontal air dispersing device 7 cannot be manufactured as a one-piece casting. Instead, the device comprises the separate upper and lower parts that are interconnected. By inserting a projection extending from a bottom of the rotating shaft 9 of the upper part 7*a* into a groove 9*b* formed on a top of the rotating shaft 9 of the lower part 7*b*, the upper and lower parts 7*a* and 7*b* are coupled to each other.

In the above described refrigerator, since the air dispersing system disperses the cool air only in a horizontal direction, the temperature within the refrigerating compartment cannot be maintained evenly in a vertical direction. This problem becomes more serious in large refrigerators. That is, when a large volume of food is located in an upper portion or a lower portion of the refrigerating compartment, since the cool air cannot be concentrated at that portion, the temperature of that portion is increased.

SUMMARY OF THE INVENTION

The present invention has been made in an effort to solve the above described problems.

It is an object of the present invention to provide a cool air dispersing system of a refrigerator that can disperse cool air, supplied to a refrigerating compartment, in a horizontal direction as well as a vertical direction.

To achieve the above object, the present invention provides a refrigerator comprising a main body forming a food storage space, an evaporator for generating cool air, and a cool air dispersing system for dispersing cool air. The cool air dispersing system comprises a horizontal cool air dispersing device disposed in a path of travel of the cool air being fed to the storage space and being rotatable about an axis for dispersing the cool air in a horizontal direction within the storage space. A motor is provided for rotating the horizontal cool air dispersing device. A vertical cool air dispersing device is disposed in the path of air travel and includes an air directing structure movable up and down for dispersing the cool air in a vertical direction within the storage space. A force-converting mechanism is connected to the horizontal cool air dispersing device and the vertical cool air dispersing device for converting rotation of the horizontal cool air dispersing device into up and down movement of the air-directing structure.

The horizontal cool air dispersing means is preferably divided into upper and lower parts and each of the upper and lower parts comprises a dispersing plate for dispersing cool air in a horizontal direction, a plurality of vanes arranged on opposite sides of the dispersing plate at different angles from each other, and a rotating shaft formed on opposite ends of the dispersing plate.

The rotating shaft of the upper device is coupled at its upper end to the motor and at its lower end is coupled to the vertical cool air dispersing device.

The first and second coupling tubes are respectively provided on a lower end of the rotating shaft of the upper part and an upper end of the rotating shaft of the lower part.

The second coupling tube is designed to have a sloped upper end, the shaft of the lower part extending into the second coupling tube, and an inserting tube having a diameter less than that of the second coupling tube extends from an upper end of the second coupling tube.

The inserting tube is designed to have a sloped upper end which is sloped at the same angle as that of the second coupling tube.

The first coupling tube is designed to have a sloped lower end, the rotating shaft extending inside the first coupling tube, and a large diameter portion having a diameter larger than that of the first coupling tube is formed on an inner circumference of the first coupling tube.

The large diameter portion is designed to be sloped at its upper and lower ends at the same angle as that of the lower end of the first coupling tube.

The depth of the large diameter portion is designed to be less than the height of the inserting tube so that a portion of the inserting tube is not inserted into the large diameter portion, thereby defining a sloped groove when the upper and lower devices are coupled to each other by the portion that is not inserted into the large diameter portion.

The refrigerator further comprises coupling means for enhancing a coupling force between the upper and lower devices The coupling means comprises an assembling projection extending from an upper surface of the rotating shaft extending into the second coupling tube and an assembling groove formed on a lower surface of the rotating shaft extending into the first coupling tube, the assembling projection being inserted into the assembling groove.

The coupling means comprises a seating projection coupled on the inner lower surface of the second coupling tube, an inserting projection extending from the seating projection, a plurality of coupling pieces extending from the inserting projection, a fixing tube formed inside the first coupling tube, in which the inserting projection is inserted, and a plurality of coupling grooves into which the coupling pieces are coupled.

When the upper and lower devices are coupled to each other, the lower end of the fixing tube contacts the upper end of the seating projection such that only a portion of the inserting tube is inserted into the first coupling tube, whereby a sloped groove is formed on an outer circumference of the coupling tube by the portion of the inserting tube which is not inserted into the first coupling tube.

The vertical cool air dispersing device comprises a supporting member having a through-hole through which the cool air passes, and a plurality of blades coupled on the supporting member to be pivotable in the vertical direction. The force converting mechanism includes an operating bar pivotally supporting the blades.

Each of the blades is made of a semicircular plate having a plurality of first rollers pivotally coupled on the supporting member and a second roller pivotally coupled on the operating bar.

A plurality of holders, each having openings in which the first and second rollers of the blades are inserted, are formed on the supporting member.

The force converting means includes the sloped groove formed on an outer circumference of the coupling tube and a connecting projection projected from the operating bar and inserted into the sloped groove.

BRIEF DESCRIPTION OR THE DRAWINGS

The above object, and other features and advantages of the present invention will become more apparent from the following detailed description of preferred embodiments thereof with reference to the attached drawings, in which.

Figure 1:
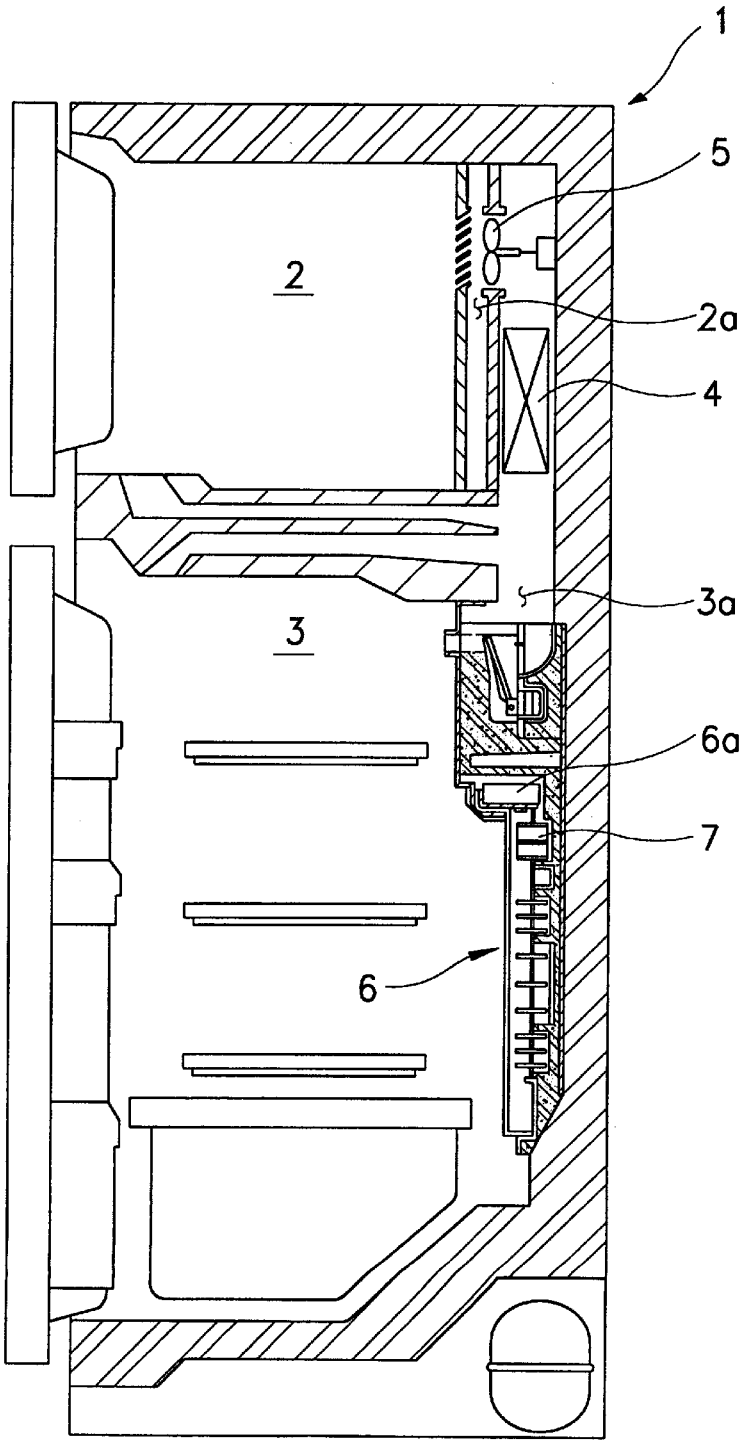
FIG. 1 (PRIOR ART)
FIG. 1 is a vertical sectional view showing a refrigerator having a conventional cool air dispersing system.
Figure 2:
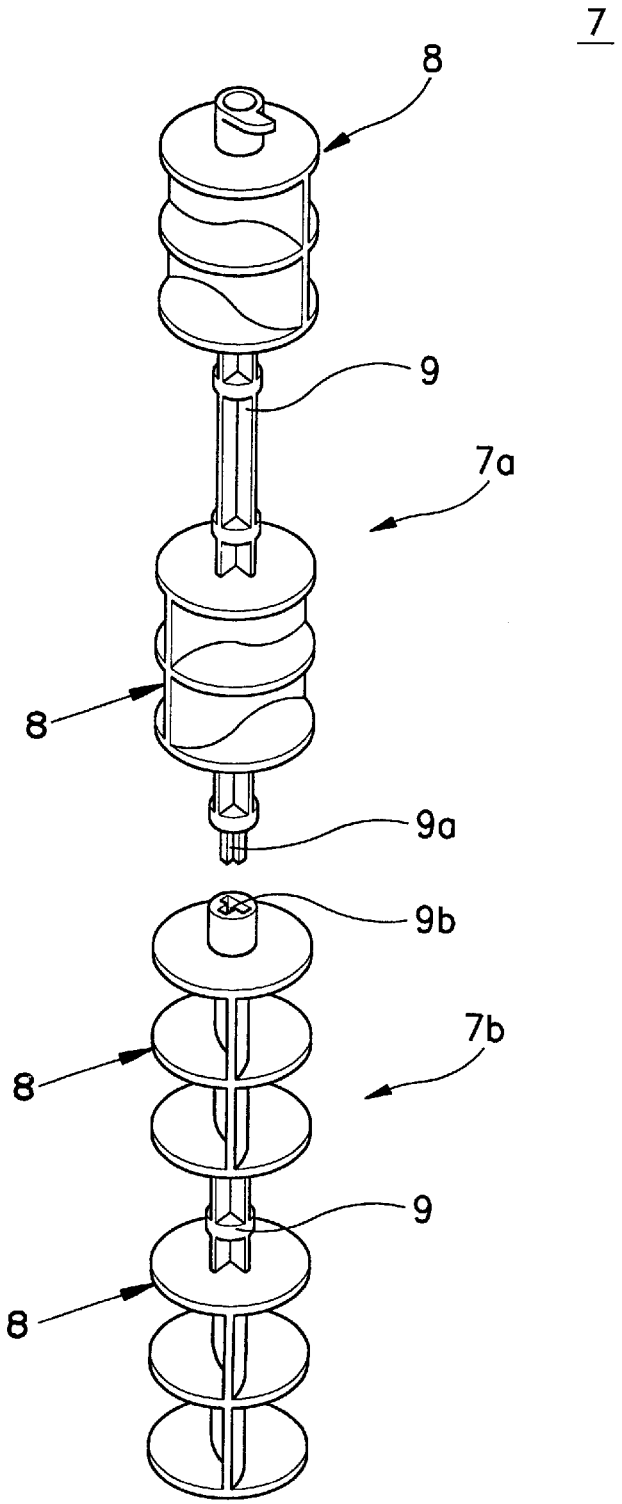
FIG. 2 (PRIOR ART)
FIG. 2 is an exploded perspective view showing a conventional horizontal cool air dispersing device.
Figure 3:
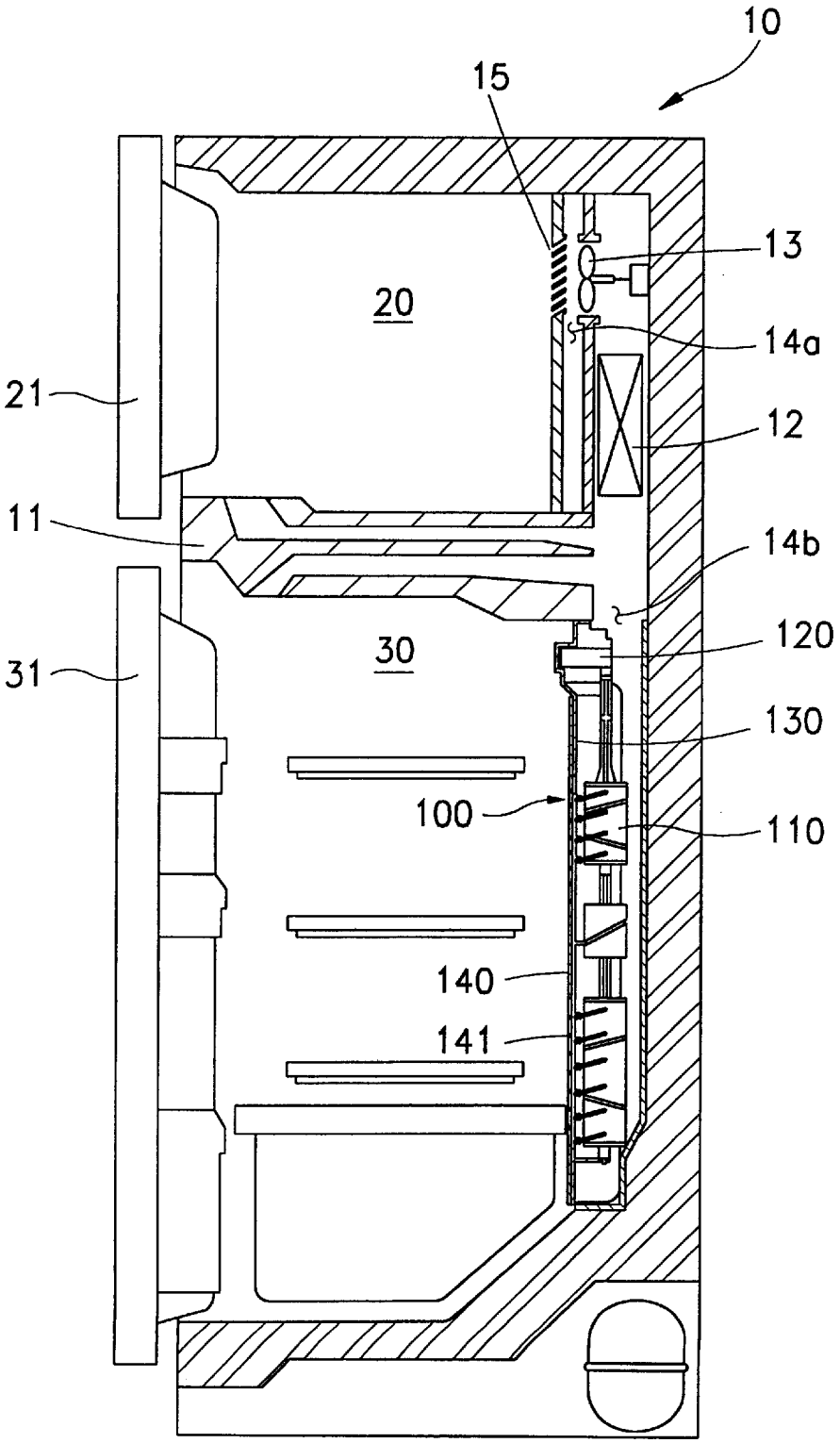
Figure 4:
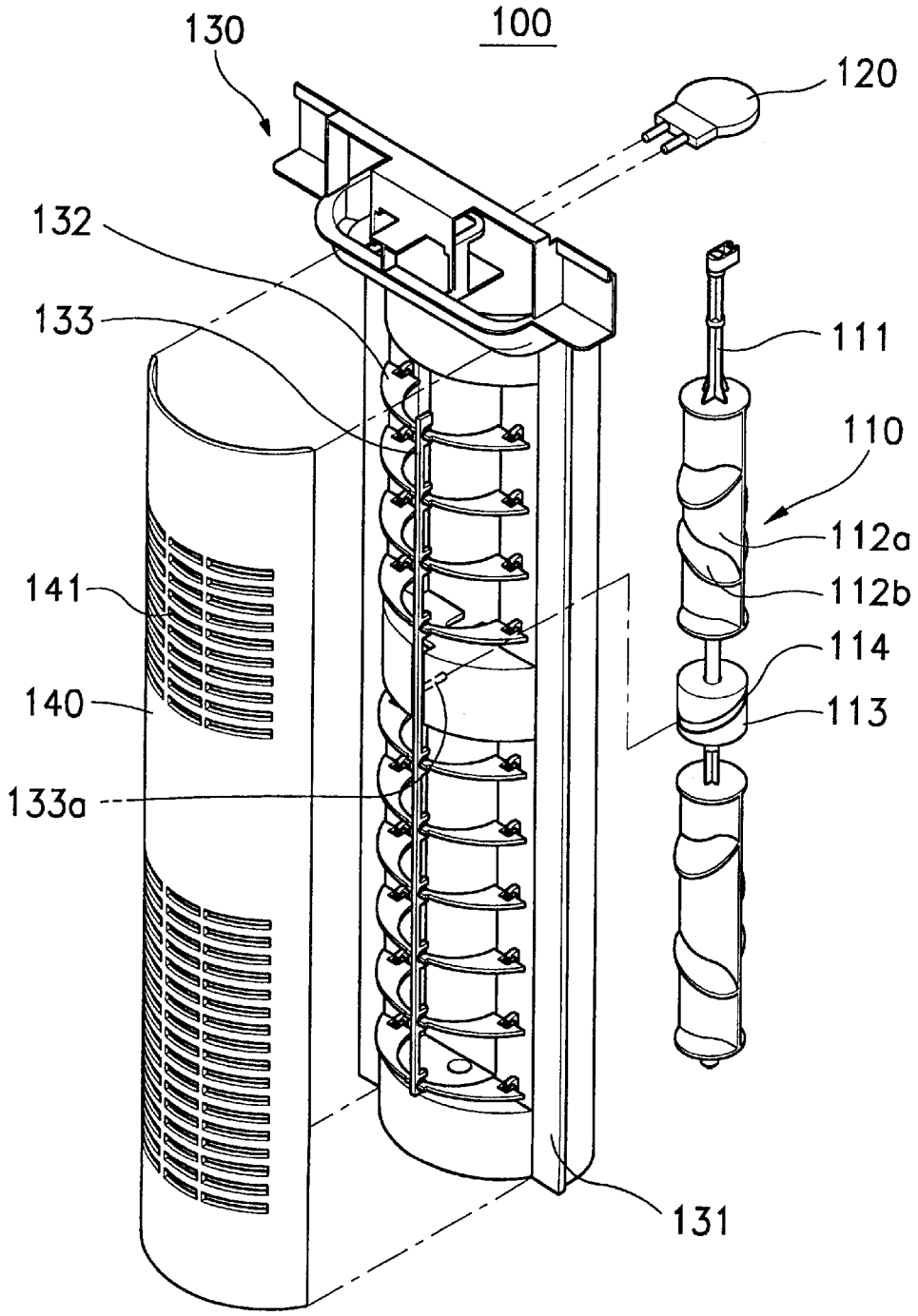
Figures 5, 5A:
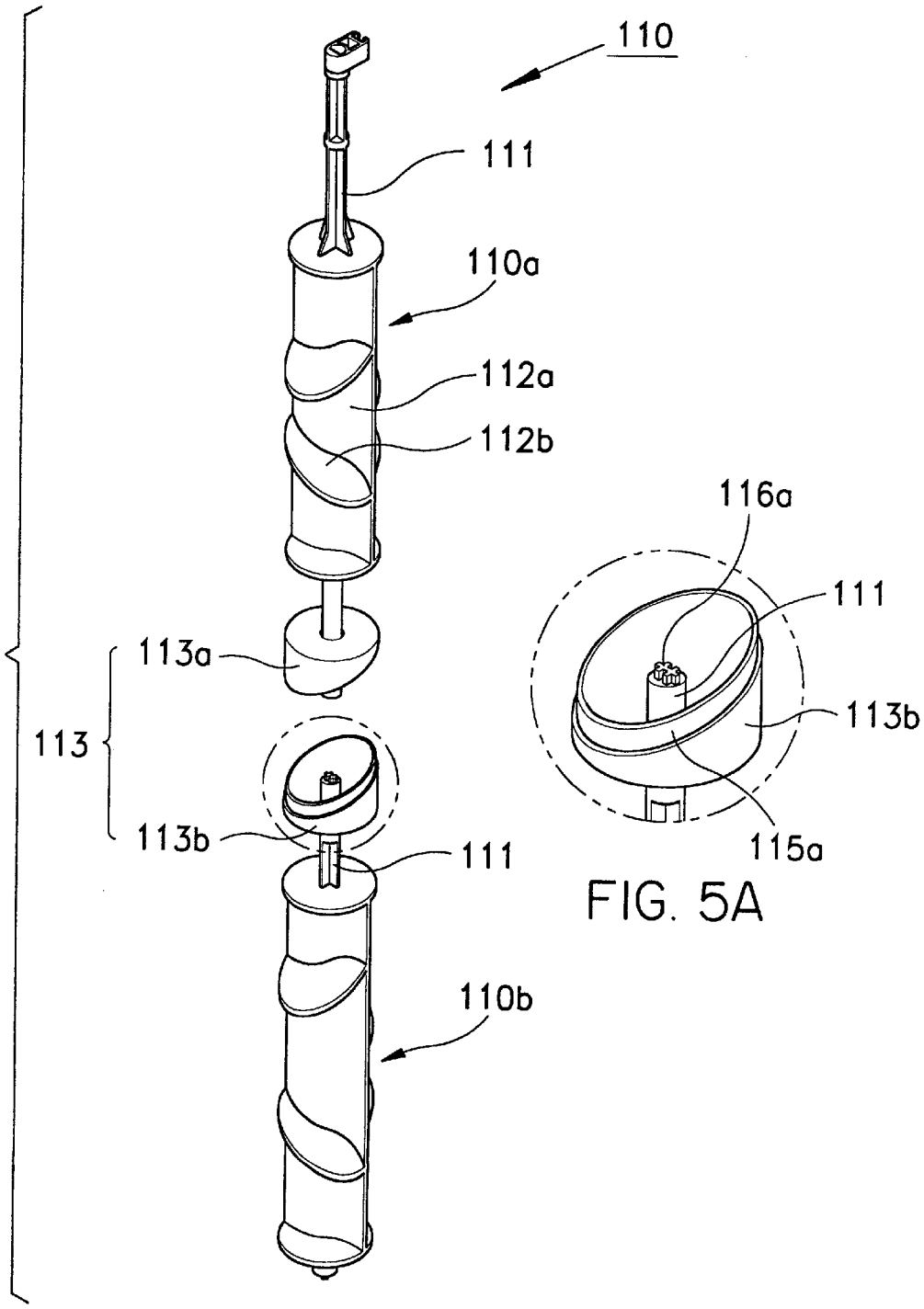
Figure 6A:
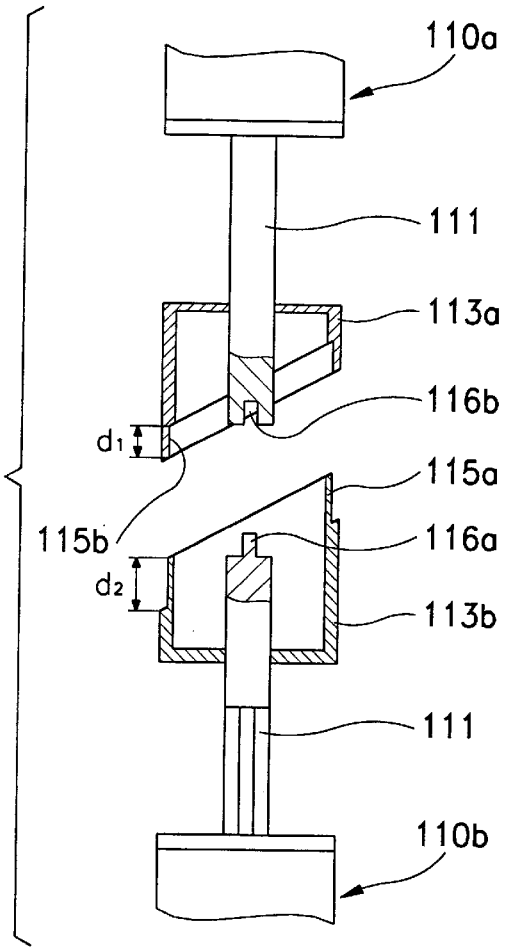
Figure 6B:
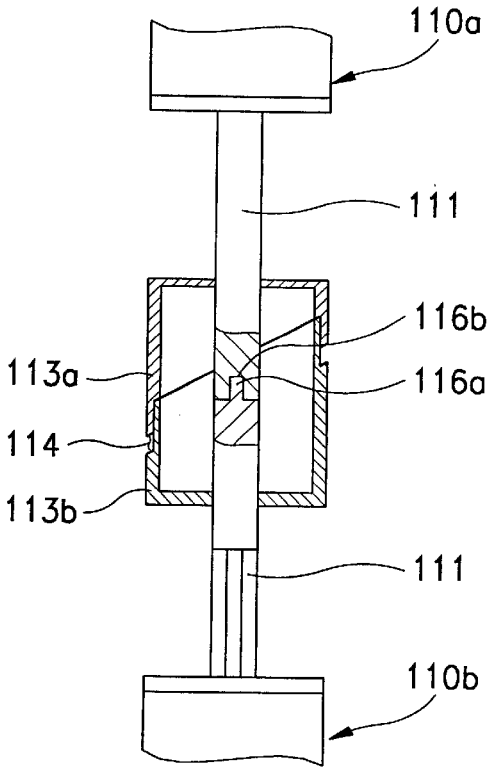
Figure 8:
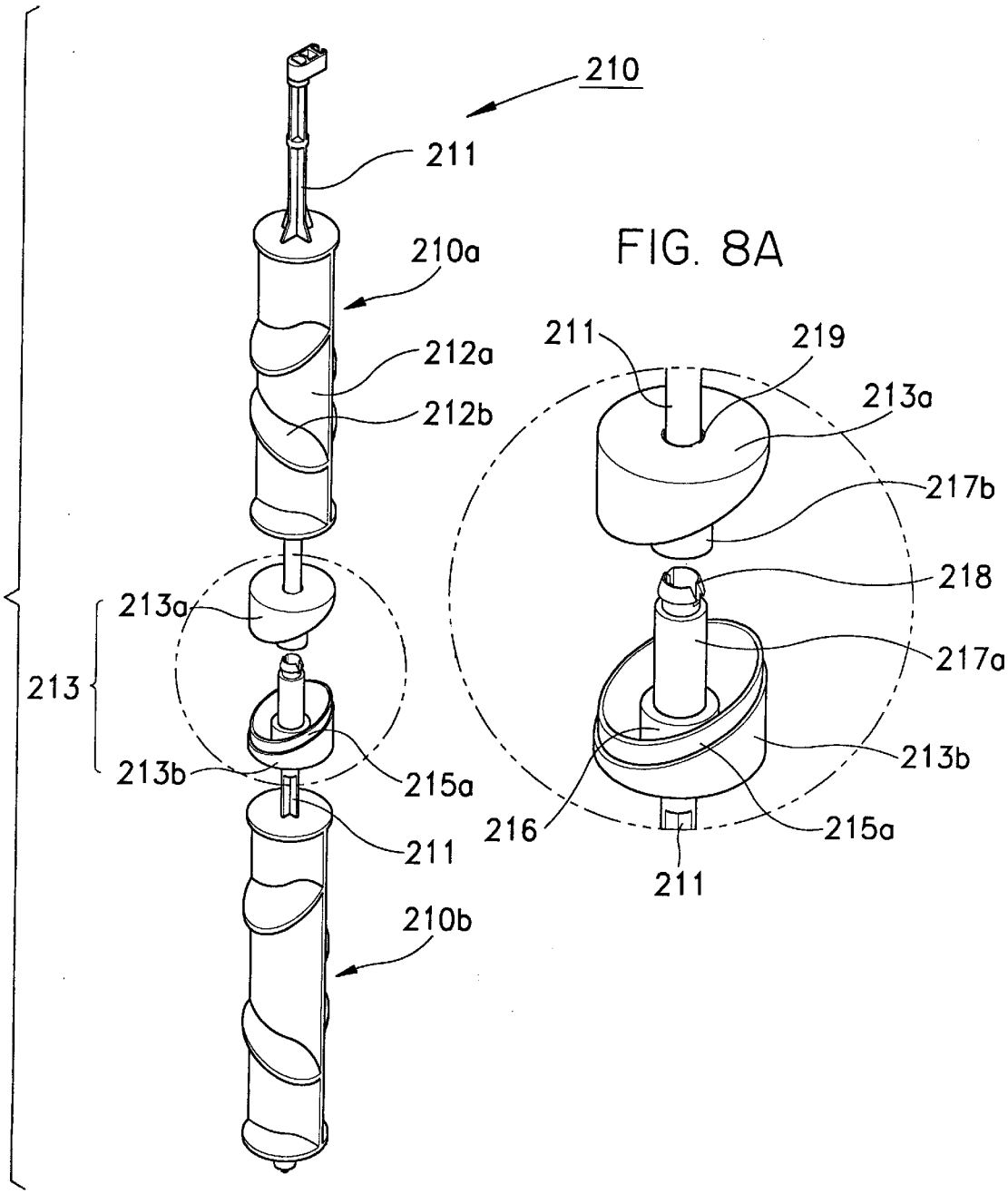
Figure 9A:
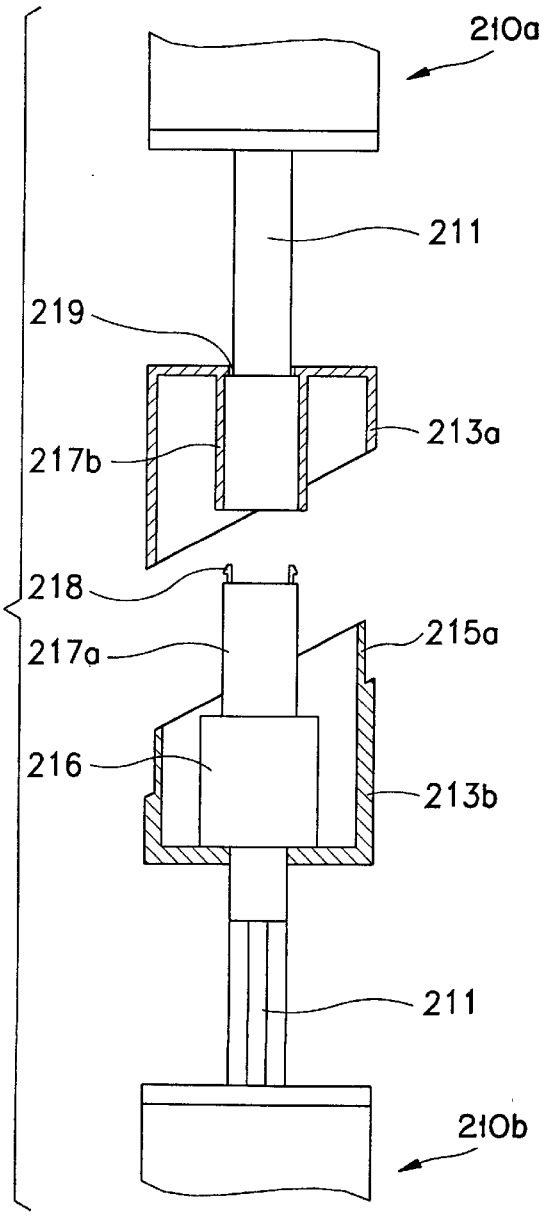
Figure 9B:
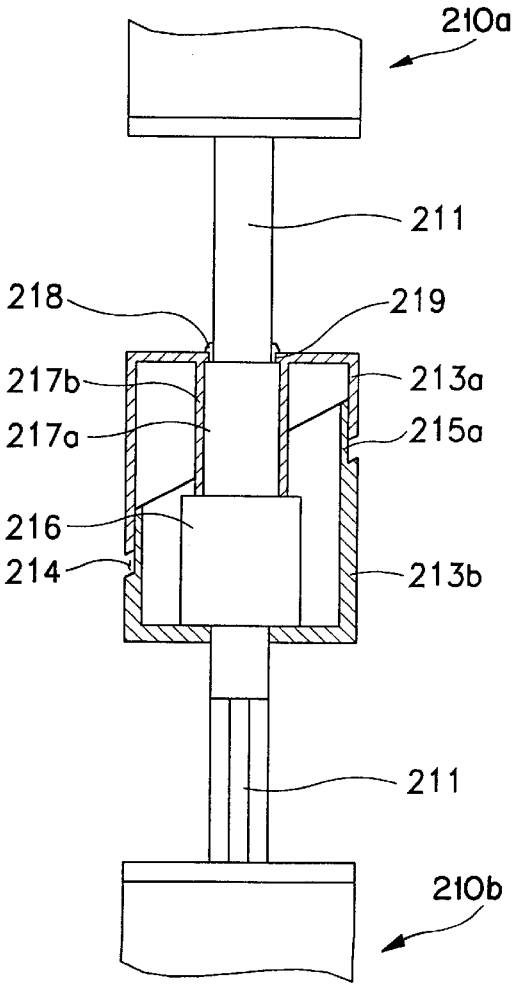
Figure 10A:
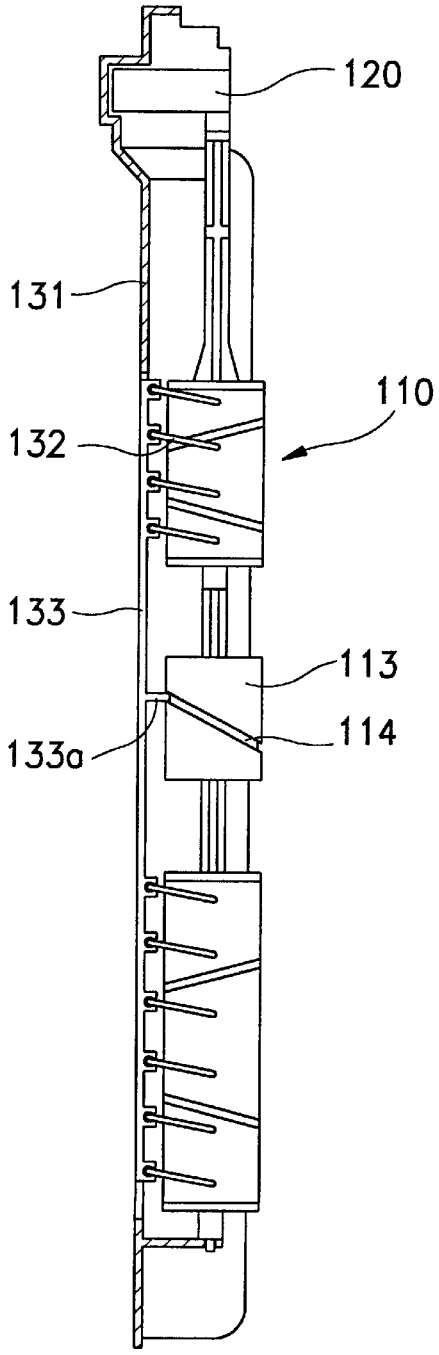
Figure 10B:
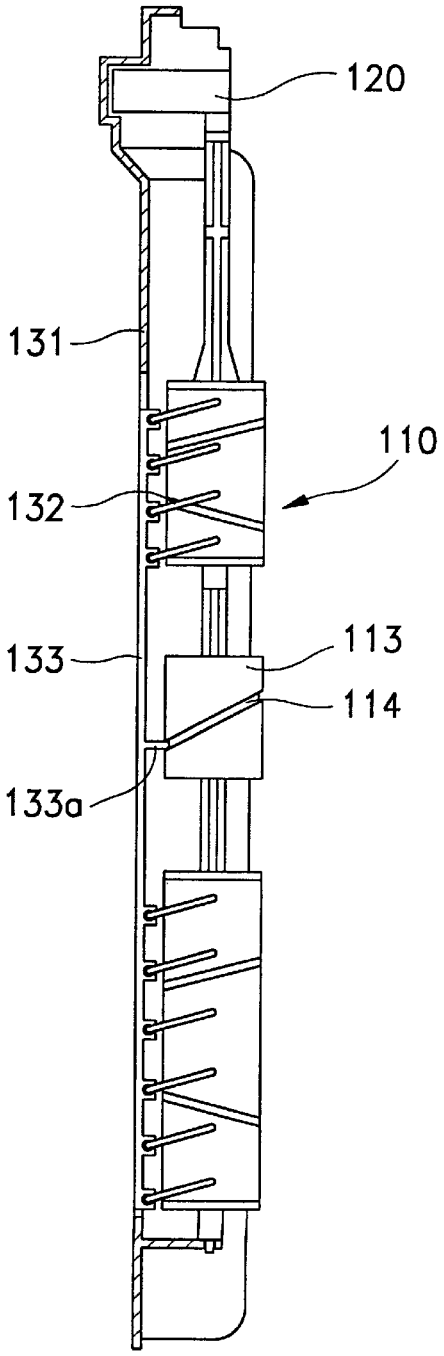

FIG. 3 a vertical sectional view showing a refrigerator having a cool air dispersing system according to a first preferred embodiment of the present invention;

FIG. 4 is an exploded perspective view showing a cool air dispersing system according to the preferred embodiment of the present invention;

FIG. 5 is an exploded perspective view showing a horizontal cool air dispersing device according to the first embodiment of the present invention;

FIG. 5*a* is an enlarged perspective view of a circled portion of FIG. 5;

FIG. 6*a* is a sectional view showing the horizontal cool air dispersing device of FIG. 5 when it is disassembled;

FIG. 6*b* is a sectional view showing the horizontal cool air dispersing device of FIG. 5 when it is assembled;

FIG. 7 is an exploded perspective view showing a vertical cool air dispersing device according to a preferred embodiment of the present invention;

FIGS. 7*a* and 7*b* are enlarged perspective views of respective circled portions of FIG. 7;

FIG. 8 is an exploded perspective view showing a horizontal cool air dispersing device according to a second embodiment of the present invention;

FIG. 8*a* is an enlarged perspective view of a circled portion of FIG. 8;

FIG. 9*a* is a sectional view showing the horizontal cool air dispersing device of FIG. 8 when it is disassembled;

FIG. 9*b* is a sectional view showing the horizontal cool air dispersing device of FIG. 5 when it is assembled; and FIGS. 10*a* and 10*b* are sectional views showing two operating positions of a cool air dispersing system of the present invention.

DETAILED DESCRIPTION OF THE PREFERRED EMBODIMENTS

Preferred embodiments of the present invention will now be described in detail with reference to the accompanying drawings.

Referring to FIG. 3, shown is a side-sectional view of a refrigerator provided with a cool air dispersing system in accordance with a preferred embodiment of the present invention.

As shown in the drawing, the refrigerator includes a main body 10 defining an exterior of the refrigerator, freezing and refrigerating compartments 20 and 30 separated from each other by a partition wall 11, and doors 21, 31 provided on a front of the refrigerator for opening and closing the freezing and refrigerating compartments 20 and 30, respectively.

Also, an evaporator 12 for generating cool air is provided behind the freezing compartment 20, and a fan 13 for forcing the cool air generated by the evaporator 12 into the freezing and refrigerating compartments 20 and 30 is disposed above the evaporator 12.

Respectively provided at the rear of the freezing and refrigerating compartments 20 and 30 are ducts 14*a* and 14*b* for guiding the fan-driven cool air generated by the evaporator 12 into the freezing and refrigerating compartments 20 and 30.

Provided in the duct 14*a* near the freezing compartment 20 is an inlet hole 15 through which cool air is induced. Provided in the duct 14*b* near the refrigerating compartment 30 is a cool air dispersing system 100 for evenly dispersing the cool air in horizontal and vertical directions within the refrigerating compartment 30. A plurality of outlet holes 141 are formed on an outlet plate 140 disposed on a front side of the cool air dispersing system 100 so that the cool air is induced into the refrigerating compartment 30 through the outlet holes 141.

The cool air dispersing system will be described hereinafter with reference to FIGS. 4 through 7.

The cool air dispersing system 100 comprises a horizontal cool air dispersing device 110 for dispersing the cool air in a horizontal direction, a motor 120 for rotating the horizontal air dispersing device 110, a vertical cool air dispersing device 130 for dispersing the cool air in the vertical direction, and a converting device for vertically moving the vertical cool air dispersing device using rotational force of the horizontal cool air dispersing device 110.

The horizontal cool air dispersing device 110 is divided into upper and lower parts 110*a* and 110*b* (see FIG. 5). Each of the upper and lower parts 110*a* and 110*b* comprises a dispersing plate 112*a* for dispersing cool air in the horizontal direction, a plurality of vanes 112*b* arranged on opposite sides of the dispersing plate 112*a* at different angles from each other, and a rotating shaft 111 formed on opposite ends of the dispersing plate 112*a*.

The rotating shaft 111 of the upper part 110*a* is connected at its upper end to the motor 120, and the rotating shaft 111 of the lower part 110*a* is coupled at its lower end to a support member 131 of the vertical cool air dispersing device 130.

First and second coupling tubes 113*a* and 113*b* are respectively provided on a lower end of the rotating shaft 111 of the upper part 110*a* and an upper end of the rotating shaft 111 of the lower part 110*b*.

Describing more in detail, the second coupling tube 113*b* coupled on the lower part 110*b* is designed to have a sloped upper end. The shaft 111 of the lower part 110*a* extends downwardly into the second coupling tube 113*b*. An inserting tube 115*a* having a diameter less than that of the second coupling tube 113*b* extends upwardly from an open end of the second coupling tube 113*b*. The inserting tube 115*a* is designed to have a sloped upper end which is sloped at the same angle as that of the second coupling tube 113*b*.

The first coupling tube 113*a* coupled to the upper part 110*a* is designed to have a lower end that slopes in complementary fashion to the sloped upper end of the second coupling tube 113*b*. The rotating shaft 111 extends inside the first coupling tube 113*a*. A large diameter portion 115*b* (see FIG. 6*a*) having a diameter larger than that of the first coupling tube 113*a* is formed on an inner circumference of the first coupling tube 113*a*. The inserting tube 115*a* is inserted into the large diameter portion 115*b*, thereby coupling the upper and lower parts 110*a* and 110*b* to each other.

As shown in FIG. 6*a*, the height d1 of the large diameter portion 115*b* is designed to be less than the height d2 of the inserting tube 115*a* so that a portion of the inserting tube 115*a* is not inserted into the large diameter portion 115*b*, thereby defining a sloped cam groove 114 (see FIG. 6*b*) when the upper and lower parts 110*a* and 110*b* are coupled to each other by the portion that is not inserted into the large diameter portion 115*b*.

Provided on the upper and lower parts 110*a* and 110*b* is coupling means for enhancing the coupling force. The coupling means comprises an assembling projection 116*a* extending from an upper surface of the rotating shaft 111 extending into the second coupling tube 113*b*, and an assembling groove 116*b* formed on a lower surface of the rotating shaft 111 extending into the first coupling tube 113*a*. The assembling projection 116*a* is inserted into the assembling groove 116*b*. That is, the upper and lower parts 110*a* and 110*b* are securely coupled to each other by the insertion of the projection 116*a* into the groove 116*b* as well as by the insertion of the large diameter portion 115*b* into the inserting groove 116*b*. To prevent damage or deformation of the assembling projection 116*a* by rotational force of the horizontal cool air dispersing device 110, it is preferable that the projection 116*b* is cross-shaped.

The vertical cool air dispersing device 130 is disposed in front of the horizontal cool air dispersing device 110 to disperse the cool air in the vertical direction. The vertical cool air dispersing device 130 comprises a supporting member 131 having a through-hole 131*b* through which the cool air passes, a plurality of air-directing blades 132 coupled on the supporting member 131 to be pivotable in the vertical direction, and an operating bar 133 for pivotally driving the blades 132.

Each of the blades 132 is made of a semicircular plate, carrying a pair of first rollers 132*a* that are pivotally coupled on the supporting member 131, and a second roller 132*b* pivotally coupled on the operating bar 133. Formed on the supporting member 131 and the operating bar 133, respectively, are a plurality of holders 131*a* and 133*b* each having openings into which the first and second rollers 132*a* and 132*b* of the blades 132 are inserted.

The blades 132 are designed to vertically pivot by the rotational force of the horizontal cool air dispersing device 110. This is realized by a converting means comprised of the sloped cam groove 114 formed on an outer circumference of the coupling tube 113 and a connecting projection or cam follower 133*a* projecting from the operating bar 133 and inserted into the sloped groove 114. That is, when the horizontal cool air dispersing device 110 is rotating, the connecting projection 133*a* moves along the sloped groove 144, whereby the operating bar 133 moves up and down. Consequently, the blades 132 coupled on both the operating bar 133 and the supporting member 131 pivot up and down to disperse the cool air in the vertical direction.

FIGS. 8, 9*a* and 9*b* show a horizontal cool air dispersing device 210 according to a second embodiment of the present invention.

As shown in drawings, the horizontal cool air dispersing device 210 according to the second embodiment is divided into upper and lower parts 210*a* and 210*b* as in the first embodiment. Each of the parts 210*a* and 210*b* comprises a dispersing plate 212*a* for dispersing the cool air in the horizontal direction, a plurality of vanes 212*b* arranged on opposite sides of the dispersing plate 112*a* at different angles from each other, and a rotating shaft 111 formed on opposite ends of the dispersing plate 112*a*.

First and second coupling tubes 213*a*, 213*b* are provided. The second coupling tube 213*b* is coupled on an upper end of the lower part 210*b*, an upper end of the second coupling tube 213*b* being sloped at a predetermined angle. An inserting tube 215*a* having a diameter less than that of the second coupling tube 213*b* extends from an open end of the second coupling tube 213*b*. The inserting tube 215*a* is designed to have a sloped upper end which is sloped at the same angle as that of the second coupling tube 213*b*.

The first coupling tube 213*a*, coupled to a lower end of the upper part 210*a*, is designed to have a lower end sloped at an angle complementary to the sloped upper end of the second coupling tube 213*b*. The rotating shaft 211 extends inside the first coupling tube 213*a*. The inserting tube 215*a* is inserted into the first coupling tube 213*a*, thereby coupling the upper and lower parts 210*a* and 210*b* to each other.

Provided on the upper and lower parts 210*a* and 210*b* is coupling means for enhancing coupling force between the same. The coupling means comprises a seating projection 216 coupled on the inner lower surface of the second coupling tube 213*b*, an inserting projection 217*a* extending from the seating projection 216, a plurality of coupling pieces 218 extending laterally from the inserting projection 217*a*, a fixing tube 217*b* formed inside the first coupling tube 213*a*, into which the inserting projection 217*a* is inserted, and a plurality of coupling grooves 219 into which the coupling pieces 218 are coupled. That is, when the inserting projection 217*a* of the second coupling tube 213*b* is inserted into the fixing tube 217*b* of the first coupling tube 213*a*, the coupling pieces 218 of the inserting projection 217*a* are fixedly inserted into the coupling groove 219 of the first coupling tube 213*a*, thereby securely coupling the upper and lower parts 210*a* and 210*b*.

In addition, when the upper and lower parts 210*a* and 210*b* are coupled to each other, as shown in FIG. 9*b*, the lower end of the fixing tube 217*b* contacts the upper end of the seating projection 216, whereby only a portion of the inserting tube 215*a* is inserted into the first coupling tube 213*a*. That is, a sloped groove 214 is formed on an outer circumference of the coupling tube 213 by the portion of the inserting tube 215*a* which is not inserted into the first coupling tube 213*a*.

Inserted into the sloped groove 214 is the connecting projection 133*a* of the operating bar 133 causing the vertical cool air dispersing device 130 to pivot in the vertical direction by rotational force of the horizontal cool air dispersing device 110.

The operation of the refrigerator having the inventive cool air dispersing system will be described hereinafter with reference to FIGS. 3, 10*a* and 10*b*.

A portion of cool air generated by the fan 13 is directed to the freezing compartment and the remainder of the cool air is directed to the cool air dispersing system 100 mounted on a rear side of the refrigerating compartment 30. The cool air directed to the cool air dispersing system 100 flows to the inside of the refrigerating compartment through the horizontal cool air dispersing device 110 or 210. At this point, since the connecting projection 133*a* of the vertical cool air dispersing device 130 moves up-and-down along the sloped groove 114 or 214 as the horizontal cool air dispersing device rotates, the blades 132 pivotally connected to the supporting member 131 of the operating bar 133 pivot in the vertical direction, thereby dispersing the cool air in the vertical direction.

While the invention has been described in connection with what is presently considered to be most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A refrigerator comprising:

a main body;

a food storage space disposed in the main body;

an evaporator for generating cool air; and a cool air dispersing system for dispersing cool air in the storage space, wherein said cool air dispersing system comprises:

a horizontal cool air dispersing device disposed in a path of travel of the cool air being fed to the storage space and being rotatable about an axis for dispersing the cool air in a horizontal direction within the storage space;

a motor for rotating the horizontal cool air dispersing device;

a vertical cool air dispersing device disposed in the path and including an air-directing structure movable up-and-down for dispersing the cool air in a vertical direction within the storage space; and a force-converting mechanism connected to the horizontal cool air dispersing device and the vertical cool air dispersing device for converting rotation of the horizontal cool air dispersing device into up-and-down movement of the air-directing structure.

2. The refrigerator of claim 1 wherein the force converting mechanism includes a groove-forming structure forming a cam groove lying in a plane inclined at an acute angle relative to horizontal, and a vertically movable driving member connected to the air directing structure and including a cam follower mounted in the cam groove to be moved vertically thereby in response to rotation of the groove-forming structure.

3. The refrigerator of claim 1 wherein the horizontal cool air dispersing device comprises upper and lower parts each part including a dispersing plate for dispersing cool air in a horizontal direction, a plurality of vanes arranged on respective opposite sides of the dispersing plate at different angles from each other, and a rotating shaft formed on opposite ends of the dispersing plate.

4. The refrigerator of claim 3 wherein the rotating shaft of the upper part is coupled at its upper end to the motor and at its lower end is coupled to the force converting mechanism.

5. The refrigerator of claim 4 wherein the force converting mechanism includes first and second coupling tubes respectively provided on a lower end of the rotating shaft of the upper part and an upper end of the rotating shaft of the lower part.

6. The refrigerator of claim 5 wherein the second coupling tube has a sloped upper end, the shaft of the lower part extending into the second coupling tube, and an inserting tube having a diameter less than that of the second coupling tube extends from an upper end of the second coupling tube.

7. The refrigerator of claim 6 wherein the inserting tube is has a sloped upper end which slopes at the same angle as the sloped upper end of the second coupling tube.

8. The refrigerator of claim 7 wherein the first coupling tube has a sloped lower end, the rotating shaft extending inside the first coupling tube, and a large diameter portion having a diameter larger than that of the first coupling tube is formed on an inner circumference of the first coupling tube.

9. The refrigerator of claim 8 wherein the large diameter portion has a lower end sloping at the same angle as the lower end of said first coupling tube.

10. The refrigerator of claim 9 wherein a height of the large diameter portion is less than a height of the inserting tube so that a sloped groove is formed between the lower end of the large diameter portion and the upper end of the second coupling tube.

11. The refrigerator of claim 5 further comprising coupling means for enhancing a coupling force between the upper and lower parts.

12. The refrigerator of claim 11 wherein the coupling means comprises an assembling projection extending from an upper surface of the rotating shaft extending into the second coupling tube and an assembling groove formed on a lower surface of the rotating shaft extending into the first coupling tube, the assembling projection being inserted into the assembling groove.

13. The refrigerator of claim 11 wherein the coupling means further comprises an upwardly projecting seating projection disposed in the second coupling tube, an inserting projection extending upwardly from the seating projection, a plurality of coupling pieces extending upwardly from the inserting projection, a fixing tube formed inside the first coupling tube and into which the inserting projection is inserted, and a plurality of coupling grooves formed at a top of the first coupling tube and into which the coupling pieces are coupled.

14. The refrigerator of claim 13 wherein when the upper and lower parts are coupled to each other, the lower end of the fixing tube contacting an upper end of the seating projection such that only a portion of the inserting tube is inserted into the first coupling tube, whereby a sloped groove is formed on an outer circumference of the coupling tube by a portion of the inserting tube which is not inserted into the first coupling tube.

15. The refrigerator of claim 1 wherein the vertical cool air dispersing mechanism comprises a supporting member having a through-hole through which the cool air passes, the air directing structure comprising a plurality of blades coupled on the supporting member to be pivotable up-and-down, the force converting mechanism including an operating bar pivotally supporting the blades and being movable vertically in response to rotation of the horizontal cool air dispensing device.

16. The refrigerator of claim 15 wherein each of the blades comprises a semicircular plate having a plurality of first rollers pivotally coupled on the supporting member and a second roller pivotally coupled on the operating bar, the rollers being rotatable about respective horizontal axes.

17. The refrigerator of claim 16 wherein a plurality of holders each having openings in which the first and second rollers of the blades are inserted are formed on the supporting member.

18. The refrigerator of one of claims 10 or 14 wherein the air-directing structure comprises a plurality of vertically spaced blades mounted for pivotal movement about respective horizontal axes, the blades being interconnected by a vertically movable operating bar, the force converting mechanism comprising the sloped groove and a projection disposed on the operating bar and extending into the sloped groove to be moved vertically thereby.

19. The refrigerator of claim 1 wherein the food storage space is divided into a refrigerating compartment and a freezing compartment, the cool air dispersing system disposed for dispersing cool air discharged into the refrigerating compartment.

* * * * *